US009679572B2

(12) United States Patent
Park et al.

(10) Patent No.: US 9,679,572 B2
(45) Date of Patent: Jun. 13, 2017

(54) METHOD AND APPARATUS FOR ENCODING/DECODING SCALABLE DIGITAL AUDIO USING DIRECT AUDIO CHANNEL DATA AND INDIRECT AUDIO CHANNEL DATA

(71) Applicant: THE KOREA DEVELOPMENT BANK, Seoul (KR)

(72) Inventors: Seung-Min Park, Seoul (KR); Jae-Yong Ihm, Seoul (KR); Dong-Jun Kim, Seoul (KR)

(73) Assignee: THE KOREA DEVELOPMENT BANK, Seoul (KR)

( * ) Notice: Subject to any disclaimer, the term of this patent is extended or adjusted under 35 U.S.C. 154(b) by 0 days.

(21) Appl. No.: 14/786,468

(22) PCT Filed: Apr. 21, 2014

(86) PCT No.: PCT/KR2014/003466
§ 371 (c)(1),
(2) Date: Oct. 22, 2015

(87) PCT Pub. No.: WO2014/175617
PCT Pub. Date: Oct. 30, 2014

(65) Prior Publication Data

US 2016/0071523 A1 Mar. 10, 2016

(30) Foreign Application Priority Data

Apr. 23, 2013 (KR) ..... 10-2013-0044985
Apr. 23, 2013 (KR) ..... 10-2013-0044987

(51) Int. Cl.
*G10L 19/008* (2013.01)
*G10L 19/24* (2013.01)

(52) U.S. Cl.
CPC ..... *G10L 19/008* (2013.01); *G10L 19/24* (2013.01)

(58) Field of Classification Search
CPC ..... G10L 19/008; G10L 19/24; H04S 3/008; H04S 2400/01; H04S 2400/15
See application file for complete search history.

(56) References Cited

U.S. PATENT DOCUMENTS 7,212,872 B1 * 5/2007 Smith ..... H04S 3/00 381/27
2002/0191107 A1 * 12/2002 Hu ..... H04N 5/04 348/515

(Continued)

FOREIGN PATENT DOCUMENTS

EP 0 924 962 A1 6/1999
JP H05-227112 A 9/1993

(Continued)

*Primary Examiner* — Sonia Gay
(74) *Attorney, Agent, or Firm* — Baker & Hostetler LLP

(57) ABSTRACT

Apparatuses and methods for encoding/decoding scalable digital audio are disclosed. An apparatus for decoding scalable digital audio according to the present invention includes: an audio packet reception unit configured to receive a digital audio packet, including a plurality of pieces of direct audio channel data mapped to respective physical channels and a plurality of pieces of indirect audio channel data indirectly mapped to respective physical channels; an indirect audio channel extraction unit configured to extract the digital audio packet from the pieces of indirect audio channel data; an indirect audio channel decoding unit configured to generate pieces of audio channel data corresponding to a number of physical channels more than the number of pieces of indirect audio channel data using the pieces of indirect audio channel data; and an audio channel output unit configured to match the pieces of audio channel data to the respective physical channels and perform output.

16 Claims, 17 Drawing Sheets

(56) References Cited

U.S. PATENT DOCUMENTS

| | | | | |
|---|---|---|---|---|
| 2006/0013405 | A1 | 1/2006 | Oh et al. | |
| 2011/0007915 | A1 | 1/2011 | Park | |
| 2013/0144632 | A1* | 6/2013 | Sung | G10L 19/005 704/503 |

FOREIGN PATENT DOCUMENTS

| | | | |
|---|---|---|---|
| KR | 10-2000-0016543 | A | 3/2000 |
| KR | 10-2003-0004394 | A | 1/2003 |
| KR | 10-1999-0067106 | A | 10/2004 |
| KR | 10-2005-0090448 | A | 9/2005 |
| KR | 10-2006-0043701 | A | 5/2006 |
| KR | 10-2008-0021752 | A | 3/2008 |
| KR | 10-2008-0036119 | A | 4/2008 |
| KR | 10-2009-0100566 | A | 9/2009 |
| KR | 10-2010-0090962 | A | 8/2010 |
| KR | 10-2011-0086645 | A | 7/2011 |
| WO | 97/16026 | A1 | 5/1997 |
| WO | 01/87015 | A2 | 11/2001 |
| WO | 2004/062291 | A1 | 7/2004 |
| WO | 2007/013775 | A1 | 2/2007 |
| WO | 2008/140263 | A1 | 11/2008 |

* cited by examiner

| CHANNEL# | LABEL/NAME | DESCRIPTION |
|---|---|---|
| 1 | L/LEFT | LOUDSPEAKER AT LEFT END OF SCREEN |
| 2 | R/RIGHT | LOUDSPEAKER AT RIGHT END OF SCREEN |
| 3 | C/CENTER | LOUDSPEAKER AT CENTER OF SCREEN |
| 4 | LEF/SCREEN | SCREEN LOW-FREQUENCY EFFECT SUBWOOFER LOUDSPEAKERS |
| 5 | LS/LEFT SURROUND | SURROUND LOUDSPEAKERS ON LEFT WALL SURFACE |
| 6 | RS/RIGHT SURROUND | SURROUND LOUDSPEAKERS ON RIGHT WALL SURFACE |
| 7 | | EXTENDABLE REGION |
| 8 | | EXTENDABLE REGION |
| 9 | | EXTENDABLE REGION |
| 10 | | EXTENDABLE REGION |
| 11 | | EXTENDABLE REGION |
| 12 | | EXTENDABLE REGION |
| 13 | | EXTENDABLE REGION |
| 14 | | EXTENDABLE REGION |
| 15 | | EXTENDABLE REGION |
| 16 | | EXTENDABLE REGION |

FIG. 5

| CHANNEL# | LABEL/NAME | DESCRIPTION |
|---|---|---|
| 1 | L/LEFT | LOUDSPEAKER AT LEFT END OF SCREEN |
| 2 | R/RIGHT | LOUDSPEAKER AT RIGHT END OF SCREEN |
| 3 | C/CENTER | LOUDSPEAKER AT CENTER OF SCREEN |
| 4 | LEF/SCREEN | SCREEN LOW-FREQUENCY EFFECT SUBWOOFER LOUDSPEAKERS |
| 5 | LS/LEFT SURROUND | SURROUND LOUDSPEAKERS ON LEFT WALL SURFACE |
| 6 | RS/RIGHT SURROUND | SURROUND LOUDSPEAKERS ON RIGHT WALL SURFACE |
| 7 | LC/LEFT CENTER | LOUDSPEAKER AT MIDDLE BETWEEN CENTER OF SCREEN AND LEFT END |
| 8 | RC/RIGHT CENTER | LOUDSPEAKER AT MIDDLE BETWEEN CENTER OF SCREEN AND RIGHT END |
| 9 | | EXTENDABLE REGION |
| 10 | | EXTENDABLE REGION |
| 11 | | EXTENDABLE REGION |
| 12 | | EXTENDABLE REGION |
| 13 | | EXTENDABLE REGION |
| 14 | | EXTENDABLE REGION |
| 15 | | EXTENDABLE REGION |
| 16 | | EXTENDABLE REGION |

FIG. 6

| CHANNEL CONTAINER | CONFIGURATION | | | LOCATION OF PHYSICAL SPEAKER |
|---|---|---|---|---|
| | 5.1 | 7.1 SDDS | 7.1 DS | |
| 1 | L | L | L | LEFT |
| 2 | R | R | R | RIGHT |
| 3 | C | C | C | CENTER |
| 4 | LFE | LFE | LFE | LOW FREQUENCY EFFECTS |
| 5 | LS | LS | LSS | LEFT SURROUND(OR LEFT SIDE SURROUND) |
| 6 | RS | RS | RSS | RIGHT SURROUND(OR RIGHT SIDE SURROUND) |
| 7 | HI | | | HEARING IMPAIRED (WITH EMPHASIS ON DIALOG) |
| 8 | VI-N | | | VISUALLY IMPAIRED NARRATIVE (AUDIO DESCRIPTION) |
| 9 | - | LC | - | LEFT CENTER |
| 10 | - | RC | - | RIGHT CENTER |
| 11 | - | - | LRS | LEFT REAR SURROUND |
| 12 | - | - | RRS | RIGHT REAR SURROUND |
| 13 | MOTION DATA | | | SYNCHRONOUS SIGNAL (CURRENTLY USED BY D-BOX) |
| 14 | - | - | - | EXTENDABLE REGION |
| 15 | - | - | - | EXTENDABLE REGION |
| 16 | - | - | - | EXTENDABLE REGION |

FIG. 7

| CHANNEL CONTAINER | CONFIGU-RATION | | LOCATION OF PHYSICAL SPEAKER | DIGITAL AUDIO PACKET |
|---|---|---|---|---|
| | 5.1 | 7.1 DS | | |
| 1 | L | L | LEFT | L |
| 2 | R | R | RIGHT | R |
| 3 | C | C | CENTER | C |
| 4 | LFE | LFE | LOW FREQUENCY EFFECTS | LFE |
| 5 | LS | LSS | LEFT SURROUND | LS |
| 6 | RS | RSS | RIGHT SURROUND | RS |
| 7 | HI | HI | HEARING IMPAIRED (WITH EMPHASIS ON DIALOG) | HI |
| 8 | VI-N | VI-N | VISUALLY IMPAIRED NARRATIVE (AUDIO DESCRIPTION) | VI-N |
| 9 | - | - | EXTENDABLE REGION | STA-CHANNEL 1 |
| 10 | - | - | EXTENDABLE REGION | STA-CHANNEL 2 |
| 11 | - | LRS | LEFT REAR SURROUND | LRS |
| 12 | - | RRS | RIGHT REAR SURROUND | RRS |
| 13 | - | - | EXTENDABLE REGION | STA-CHANNEL 3 |
| 14 | - | - | EXTENDABLE REGION | STA-CHANNEL 4 |
| 15 | - | - | EXTENDABLE REGION | STA-CHANNEL 5 |
| 16 | - | - | EXTENDABLE REGION | STA-CHANNEL 6 |

FIG. 8

METHOD AND APPARATUS FOR ENCODING/DECODING SCALABLE DIGITAL AUDIO USING DIRECT AUDIO CHANNEL DATA AND INDIRECT AUDIO CHANNEL DATA

CROSS-REFERENCE TO RELATED APPLICATIONS

This application is a National Stage of International patent application PCT/US2014/003466, filed on Apr. 21, 2014, which claims priority to Korean patent application no. 10-2013-0044985, filed Apr. 23, 2013 and Korean patent application no. 10-2013-0044987, filed Apr. 23, 2013, the disclosures of which are incorporated by reference in their entirety.

TECHNICAL FIELD

The present invention relates to technology for encoding and decoding digital audio, and more particularly to a method and apparatus for encoding and decoding scalable digital audio, which can efficiently package high-multichannel digital audio into a digital audio packet.

BACKGROUND ART

As the demand for enjoying movies using high-quality images and sounds increases, the importance of more dynamic and realistic sounds continues to increase. Accordingly, the number of consumers who spare no expense to purchase not only video apparatuses, such as projectors or large-sized displays, but also high-multichannel speaker systems is gradually increasing.

Representative digital audio formats include a format for 5.1 channel audio and a format for 7.1 channel sound.

5.1 channel sound is a method in which 5 speakers are disposed on left, center and right sides in front of a listener and on left and right sides behind the listener and a (0.1 channel) subwoofer adapted to augment low-pitched sound is separately configured. The front left and right and rear left and right speakers function to provide a three-dimensional (3D) sound effect for a fixed listener, and the front center speaker functions to fix the conversation of a performer on a screen on the front screen for the sake of a moving listener. Representative 5.1 channel sound methods include Dolby digital 5.1, known as AC-3 format, and DTS (Digital Theater Systems).

7.1 channel sound is a surround sound listening method composed of 7 directional speakers and a single subwoofer. 7.1 channel sound is a method that improves a 3D effect by adding 2 speakers on either side of conventional 5.1 channels composed of 5 directional speakers and a single subwoofer.

FIG. 1 shows diagrams showing the sound fields of representative 5.1 channel sound and representative 7.1 channel sound.

Referring to FIG. 1, in the case of general 5.1 channel sound 110, 3 channels L, C and R, two surround channels Ls and Rs and a subwoofer LFE are provided on the front side thereof. In the case of 5.1 channel-EX sound 120, a center surround channel Cs is added to the general 5.1 channel sound 110. In 7.1 channel-DS sound 130, the center surround channel is divided into two channels Lrs and Rrs in the 5.1 channel-EX sound 120. In 7.1 channel-SDDS sound 140, two channels Lc and Rc are added among three front channels in the general 5.1 channel sound 110.

Apart from the 5.1 channel sound and the 7.1 channel sound shown in FIG. 1, Korean Patent Application Publication No. 10-2009-0100566 discloses a high-multichannel speaker system in which a plurality of small-sized speakers is arranged behind a display monitor in order to provide more realistic high-quality 3D sound.

FIG. 2 is a diagram showing a display screen disclosed in Korean Patent Application Publication No. 10-2009-0100566 and a high-multichannel array speaker system arranged behind the display screen.

Referring to FIG. 2, it can be seen that 2D-array speakers are arranged behind a display screen and sounds are output in association with the objects of a displayed screen.

In order to output sounds in association with objects via the array speakers behind the screen, conventional 5.1 channel sound and 7.1 channel sound are insufficient, and more audio channels must be assigned.

For example, if the number of speakers arranged behind the screen is 15, 12 additional audio channels are required compared to conventional 5.1 channels in which 3 speakers are arranged behind a screen.

Furthermore, one of the important issues of high-multichannel audio systems is compatibility with a conventional 5.1 channel sound system or 7.1 channel sound system. That is, even when the same digital audio packet is provided to a theater, sound must be able to be output via a larger number of channels, i.e., 5.1 channels, 7.1 channels or 16 or more channels in accordance with the sound system environment of the theater.

Accordingly, there is an urgent need for new encoding/decoding technology that can efficiently encode high-multichannel audio as well as conventional 5.1 channel audio and conventional 7.1 channel audio.

DISCLOSURE

Technical Problem

An object of the present invention is to effectively package high-multichannel sound data into a digital audio packet while maintaining compatibility with conventional sound systems, such as a 5.1 channel sound system and a 7.1 channel sound system.

Another object of the present invention is to provide audio data in an optimum form while maintaining compatibility with a sound system environment capable of supporting only a conventional sound system and a high-end sound system environment capable of real-time high-multichannel sound system decoding.

A further object of the present invention is to immediately output sounds without an inconvenient operation, such as decoding or decompression, in a sound system environment supporting only a conventional sound system and to rapidly restore high-multichannel audio data and then output realistic sounds in a high-multichannel high-end sound system environment.

Technical Solution

In order to accomplish the above objects, according to the present invention, there is provided a method of decoding scalable digital audio, including: receiving a digital audio packet, including a plurality of pieces of direct audio channel data mapped to respective physical channels in a one-to-one correspondence and a plurality of pieces of indirect audio channel data indirectly mapped to respective physical channels; extracting the pieces of direct audio channel data from the digital audio packet; and matching the pieces of direct audio channel data to the respective physical channels in a one-to-one correspondence and then performing output.

Furthermore, according to an embodiment of the present invention, there is provided a method of decoding scalable digital audio, including: receiving a digital audio packet, including a plurality of pieces of direct audio channel data mapped to respective physical channels in a one-to-one correspondence and a plurality of pieces of indirect audio channel data indirectly mapped to respective physical channels; extracting the digital audio packet from the pieces of indirect audio channel data; generating pieces of audio channel data corresponding to a number of physical channels more than the number of pieces of indirect audio channel data using the pieces of indirect audio channel data; and matching the pieces of audio channel data to the respective physical channels in a one-to-one correspondence and then performing output.

In this case, the pieces of direct audio channel data may be pulse code modulated wave files, and may be maintained in a state of being uncompressed while the digital audio packet is being packaged, distributed, and stored.

In this case, the digital audio packet may include a plurality of channel containers each adapted to record digital audio channel data; and each of the pieces of direct audio channel data and the pieces of indirect audio channel data may be mapped to one of the plurality of channel containers in a one-to-one correspondence.

In this case, the pieces of indirect audio channel data may be recorded in at least part of the remainder of the channel containers in which the pieces of direct audio channel data have not been recorded.

In this case, generating the pieces of audio channel data may include generating the pieces of audio channel data corresponding to a number of physical channels more than the number of pieces of indirect audio channel data by performing a decompression process on the pieces of indirect audio channel data.

In this case, the digital audio packet may include 16 channel containers; the number of the pieces of direct audio channel data may be equal to or more than 6 and equal to or less than 11; and the number of pieces of indirect audio channel data may be 6.

In this case, the number of pieces of direct audio channel data may be even.

In this case, the pieces of audio channel data may be output as respective audio outputs of a high-multichannel audio system for a theater, which are equal to or more than 16 channels and equal to or fewer than 256 channels.

In this case, the method may further include receiving channel assignment information corresponding to the digital audio packet, and generating the pieces of audio channel data may be performed based on the channel assignment information.

Furthermore, according to an embodiment of the present invention, there is provided a method of coding scalable digital audio, including: generating a plurality of pieces of direct audio channel data mapped to respective physical channels in a one-to-one correspondence; generating pieces of indirect audio channel data that are synchronized with video sources corresponding to the pieces of direct audio channel data and that are indirectly mapped to respective physical channels; and generating a digital audio packet using the pieces of direct audio channel data and the pieces of indirect audio channel data.

In this case, the number of pieces of indirect audio channel data may be less than the number of physical channels corresponding to the pieces of indirect audio channel data.

In this case, the method may further include providing channel assignment information corresponding to the digital audio packet, together with the digital audio packet, so that the channel assignment information can be considered when the digital audio packet is decoded in a decoding stage.

Furthermore, according to an embodiment of the present invention, there is provided an apparatus for decoding scalable digital audio, including: an audio packet reception unit configured to receive a digital audio packet, including a plurality of pieces of direct audio channel data mapped to respective physical channels in a one-to-one correspondence and a plurality of pieces of indirect audio channel data indirectly mapped to respective physical channels; a direct audio channel extraction unit configured to extract the pieces of direct audio channel data from the digital audio packet; and an audio channel output unit configured to match the pieces of direct audio channel data to the respective physical channels in a one-to-one correspondence and then perform output.

Furthermore, according to an embodiment of the present invention, there is provided an apparatus for decoding scalable digital audio, including: an audio packet reception unit configured to receive a digital audio packet, including a plurality of pieces of direct audio channel data mapped to respective physical channels in a one-to-one correspondence and a plurality of pieces of indirect audio channel data indirectly mapped to respective physical channels; an indirect audio channel extraction unit configured to extract the digital audio packet from the pieces of indirect audio channel data; an indirect audio channel decoding unit configured to generate pieces of audio channel data corresponding to a number of physical channels more than the number of pieces of indirect audio channel data using the pieces of indirect audio channel data; and an audio channel output unit configured to match the pieces of audio channel data to the respective physical channels in a one-to-one correspondence and then perform output.

Furthermore, according to an embodiment of the present invention, there is provided an apparatus for coding scalable digital audio, including: a direct audio channel generation unit configured to generate a plurality of pieces of direct audio channel data mapped to respective physical channels in a one-to-one correspondence; an indirect audio channel generation unit configured to generate pieces of indirect audio channel data that are synchronized with video sources corresponding to the pieces of direct audio channel data and that are indirectly mapped to respective physical channels; and a digital audio packet generation unit configured to generate a digital audio packet using the pieces of direct audio channel data and the pieces of indirect audio channel data.

Furthermore, according to an embodiment of the present invention, there is provided a method of decoding scalable digital audio, including: receiving a digital audio packet, including a plurality of pieces of uncompressed audio channel data maintained in a state of being uncompressed and a plurality of pieces of compressed audio channel data generated by compressing pieces of audio channel data corresponding to respective physical channels; extracting the pieces of uncompressed audio channel data from the digital audio packet; and matching the pieces of uncompressed audio channel data to the respective physical channels in a one-to-one correspondence and then performing output.

Furthermore, according to an embodiment of the present invention, there is provided a method of decoding scalable digital audio, including: receiving a digital audio packet, including a plurality of pieces of uncompressed audio channel data maintained in a state of being uncompressed and a plurality of pieces of compressed audio channel data generated by compressing pieces of audio channel data corresponding to respective physical channels; extracting the pieces of compressed audio channel data from the digital audio packet; generating the pieces of audio channel data corresponding to a number of physical channels more than the number of pieces of compressed audio channel data using the pieces of compressed audio channel data; and matching the pieces of audio channel data to the respective physical channels in a one-to-one correspondence and then performing output.

In this case, the pieces of uncompressed audio channel data may be pulse code modulated wave files, and may be maintained in a state of being uncompressed while the digital audio packet is being packaged, distributed, and stored.

In this case, the digital audio packet may include a plurality of channel containers each adapted to record digital audio channel data; and each of the pieces of uncompressed audio channel data and the pieces of compressed audio channel data may be mapped to one of the plurality of channel containers in a one-to-one correspondence.

The pieces of compressed audio channel data may be recorded in at least part of the remainder of the channel containers in which the pieces of uncompressed audio channel data have not been recorded.

In this case, generating the pieces of audio channel data may include generating the pieces of audio channel data corresponding to a number of physical channels more than the number of pieces of compressed audio channel data by performing a decompression process on the pieces of compressed audio channel data.

In this case, the digital audio packet may include 16 channel containers; the number of the pieces of uncompressed audio channel data may be equal to or more than 6 and equal to or less than 11; and the number of pieces of compressed audio channel data may be 6.

In this case, the number of pieces of uncompressed audio channel data may be even.

In this case, the pieces of audio channel data may be output as respective audio outputs of a high-multichannel audio system for a theater, which are equal to or more than 16 channels and equal to or fewer than 256 channels.

In this case, the method may further include receiving channel assignment information corresponding to the digital audio packet; generating the pieces of audio channel data may be performed based on the channel assignment information.

Furthermore, according to an embodiment of the present invention, there is provided a method of coding scalable digital audio, including: generating a plurality of pieces of uncompressed audio channel data that is maintained in a state of being uncompressed; generating pieces of compressed audio channel data that are synchronized with video sources corresponding to the pieces of uncompressed audio channel data and that are generated by compressing pieces of audio channel data corresponding to respective physical channels; and generating a digital audio packet using the pieces of uncompressed audio channel data and the pieces of compressed audio channel data.

In this case, the number of pieces of compressed audio channel data may be less than the number of physical channels corresponding to the pieces of compressed audio channel data.

In this case, the method may further include providing channel assignment information corresponding to the digital audio packet, together with the digital audio packet, so that the channel assignment information can be considered when the digital audio packet is decoded in a decoding stage.

Furthermore, according to an embodiment of the present invention, there is provided an apparatus for decoding scalable digital audio, including: an audio packet reception unit configured to receive a digital audio packet, including a plurality of pieces of uncompressed audio channel data maintained in a state of being uncompressed and a plurality of pieces of compressed audio channel data generated by compressing pieces of audio channel data corresponding to respective physical channels; an uncompressed audio channel extraction unit configured to extract the pieces of uncompressed audio channel data from the digital audio packet; and an audio channel output unit configured to match the pieces of uncompressed audio channel data to the respective physical channels in a one-to-one correspondence and then perform output.

Furthermore, according to an embodiment of the present invention, there is provided an apparatus for decoding scalable digital audio, including: an audio packet reception unit configured to receive a digital audio packet, including a plurality of pieces of uncompressed audio channel data maintained in a state of being uncompressed and a plurality of pieces of compressed audio channel data generated by compressing pieces of audio channel data corresponding to respective physical channels; a compressed audio channel extraction unit configured to extract the pieces of compressed audio channel data from the digital audio packet; a compressed audio channel decoding unit configured to generate the pieces of audio channel data corresponding to a number of physical channels more than the number of pieces of compressed audio channel data using the pieces of compressed audio channel data; and an audio channel output unit configured to match the pieces of audio channel data to the respective physical channels in a one-to-one correspondence and then perform output.

Furthermore, according to an embodiment of the present invention, there is provided an apparatus for coding scalable digital audio, including: an uncompressed audio channel generation unit configured to generate a plurality of pieces of uncompressed audio channel data that is maintained in a state of being uncompressed; a compressed audio channel generation unit configured to generate pieces of compressed audio channel data that are synchronized with video sources corresponding to the pieces of uncompressed audio channel data and that are generated by compressing pieces of audio channel data corresponding to respective physical channels; and a digital audio packet generation unit configured to generate a digital audio packet using the pieces of uncompressed audio channel data and the pieces of compressed audio channel data.

Advantageous Effects

According to the present invention, it may be possible to effectively package high-multichannel sound data into a digital audio packet while maintaining compatibility with conventional sound systems, such as a 5.1 channel sound system and a 7.1 channel sound system.

Furthermore, according to the present invention, it may be possible to provide audio data in an optimum form while maintaining compatibility with a sound system environment capable of supporting only a conventional sound system and a high-end sound system environment capable of real-time high-multichannel sound system decoding.

Moreover, according to the present invention, it may be possible to immediately output sounds without an inconvenient operation, such as decoding or decompression, in a sound system environment supporting only a conventional sound system and to rapidly restore high-multichannel audio data and then output realistic sounds in a high-multichannel high-end sound system environment.

DESCRIPTION OF DRAWINGS

FIG. 5 is a table showing the case of encoding 5.1 channel sound into a digital audio packet including 16 channel containers;

FIG. 6 is a table showing the case of encoding 7.1 channel sound into a digital audio packet including 16 channel containers;

FIG. 7 is a table showing the case of encoding 5.1 channel sound, 7.1 channel SDDS and 7.1 channel DS into a digital audio packet including 16 channel containers;

FIG. 8 is a table showing the case of encoding high-multichannel audio channel data, together with 5.1 channel sound or 7.1 channel sound, into a digital audio packet including 16 channel containers;

MODE FOR INVENTION

Figure 1:
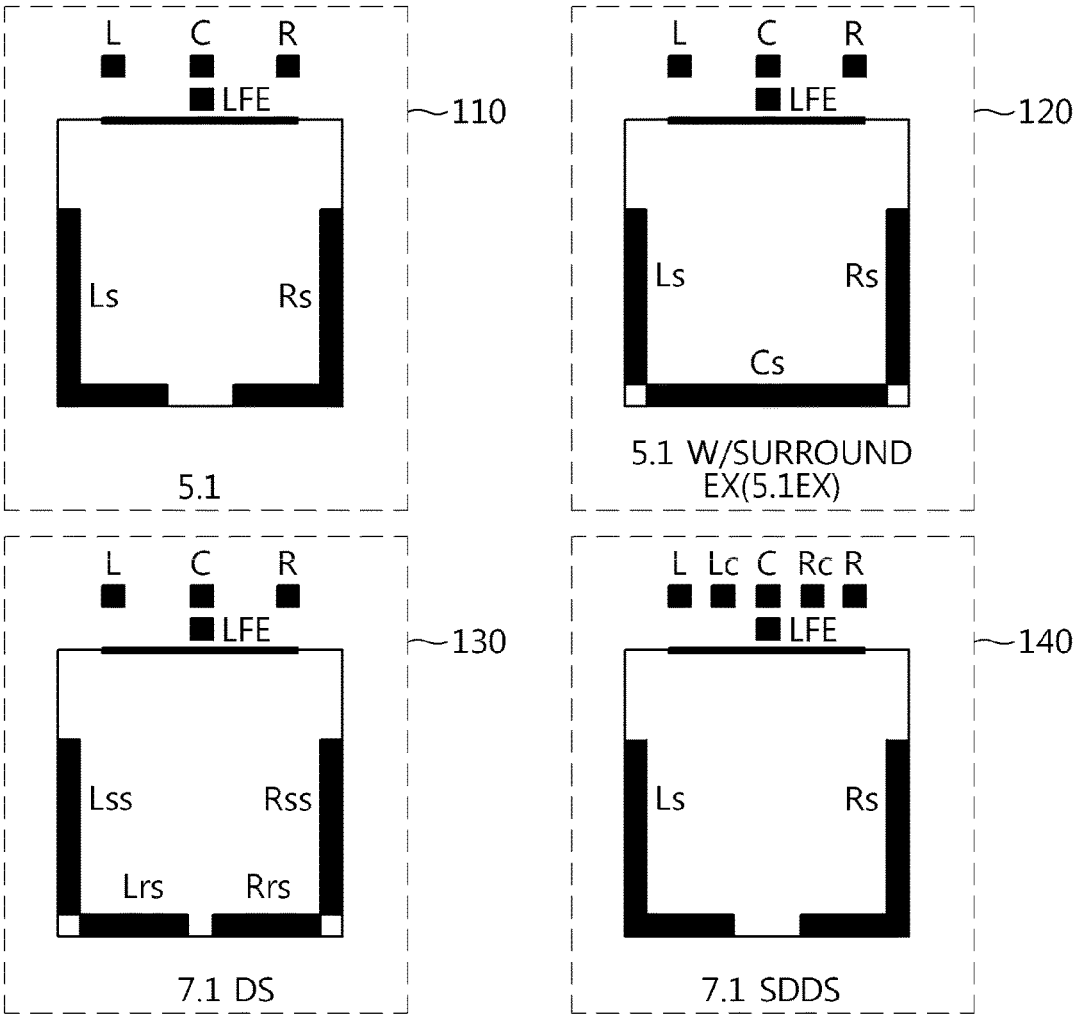
FIG. 1 shows diagrams showing the sound fields of representative 5.1 channel sound and representative 7.1 channel sound.
Figure 2:
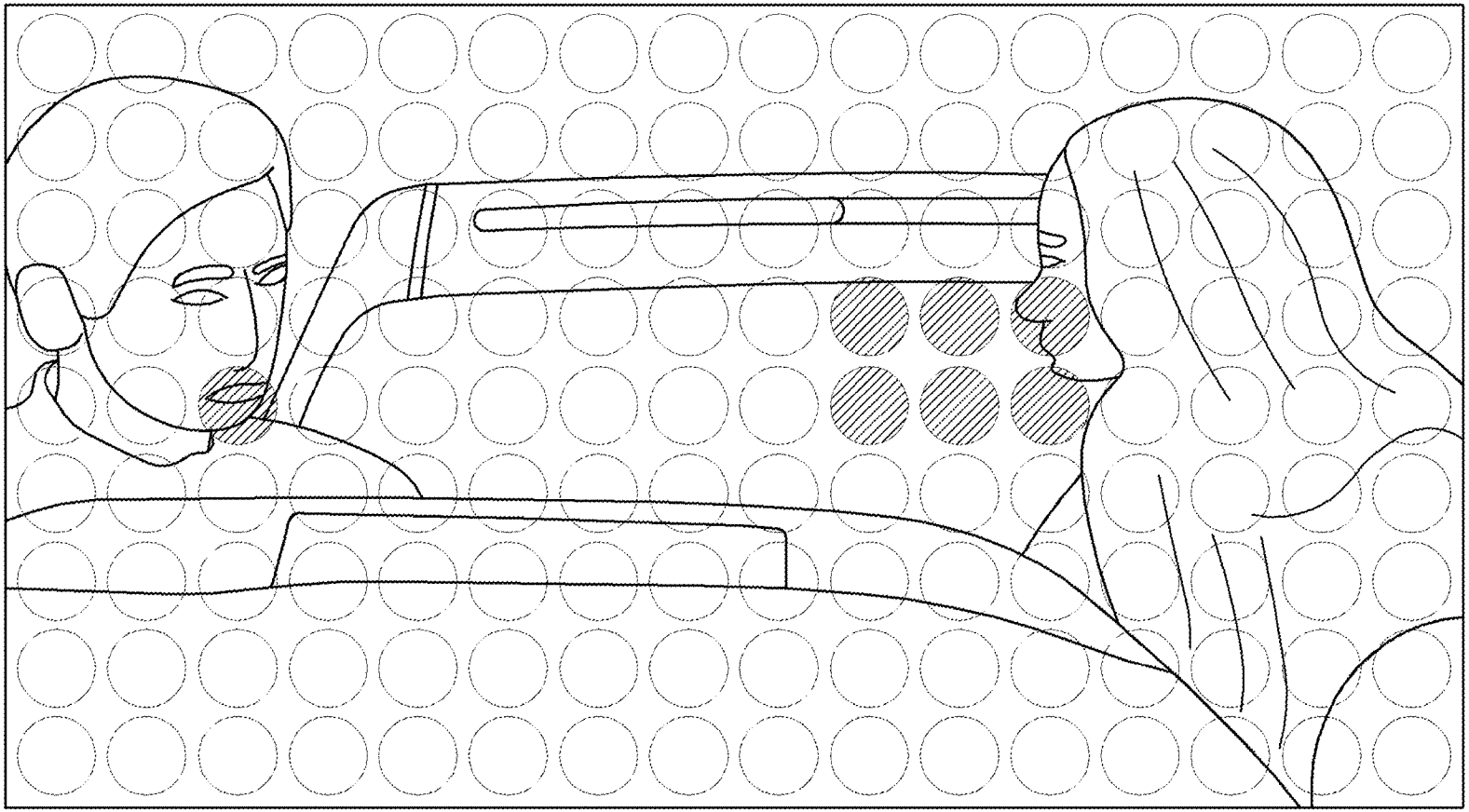
FIG. 2 is a diagram showing a display screen and a high-multichannel array speaker system arranged behind the display screen according to conventional art.

The present invention will be described in detail below with reference to the accompanying drawings. Redundant descriptions and descriptions of well-known functions and configurations that may make the gist of the present invention unnecessarily obscure will be omitted below. The embodiments of the present invention are provided to fully describe the present invention to persons having ordinary knowledge in the art to which the present invention pertains. Accordingly, the shapes, sizes and the like of components in the drawings may be exaggerated for clearer description.

Preferred embodiments according to the present invention will be described in detail with reference to the accompanying drawings.

Figure 3:
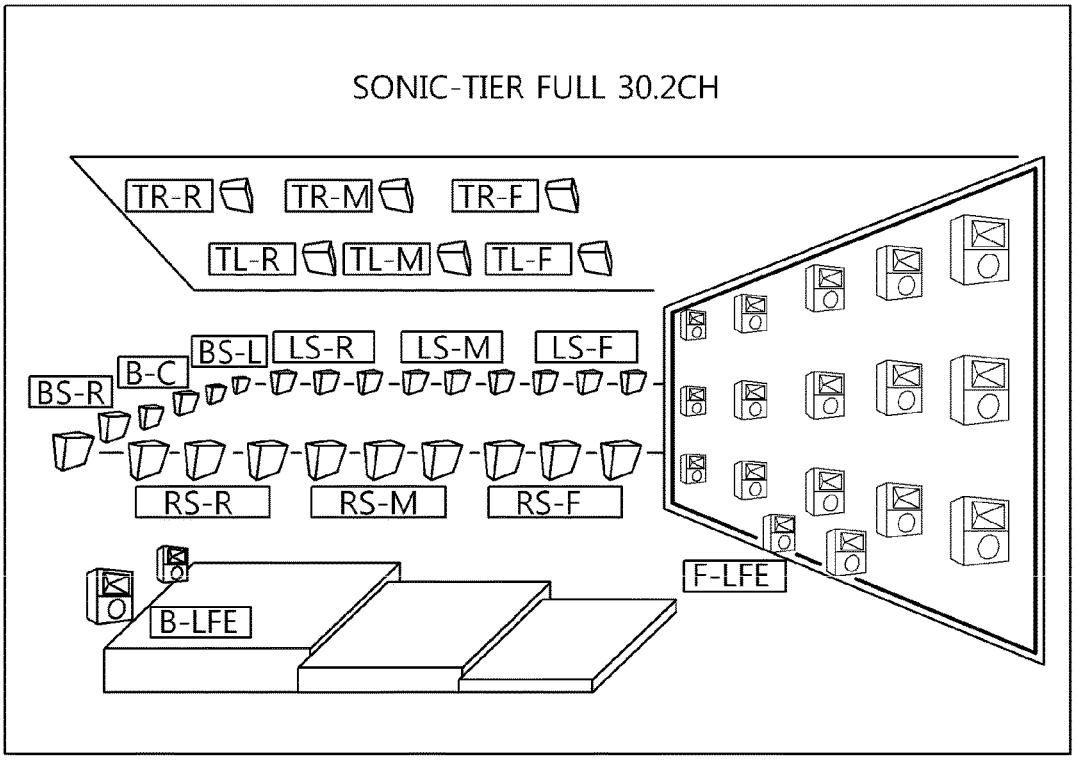
FIG. 3 is a diagram showing an example of a high-multichannel sound system.

FIG. 3 is a diagram showing an example of a high-multichannel sound system.

Referring to FIG. 3, it can be seen that the high-multichannel sound system includes a total of 30.2 channels, including 15 front channels, 6 side surround channels, 3 rear surround channels, 6 ceiling channels, and 0.2 front and rear woofer channels.

In the high-multichannel sound system shown in FIG. 3, in particular, speakers in a 5×3 array are arranged behind a front screen and thus sounds associated with objects displayed on the screen are output, thereby enabling an audience, who are watching a movie, to enjoy realistic sounds associated with objects.

In the sound system shown in FIG. 3, side surround regions may be located at the ¼ point (a front point), ⅔ point (a middle point) and ¾ point (a rear point) of the distance from the screen to the rear wall of a theater. The intervals between surround speakers may range from 1.5 to 3 m.

In this case, the heights of the surround speakers must be flush with the middle level of the screen. In the case of stadium seating, the height may be maintained in proportion to the arrangement of seats.

The ceiling speakers arranged in two rows may be horizontally aligned with the speakers of front speakers in second rows from the left and right sides. Furthermore, the ceiling speakers may be located in three side surround regions.

High-multichannel audio data, such as 30.2 channel data shown in FIG. 3, requires a larger space in an audio packet than conventional 5.1 channel audio data. During 30.2 channel audio encoding, compatibility can be ensured only if encoding is performed by taking into account compatibility with a sound system equipped with only a conventional 5.1 channel audio system.

Figure 4:
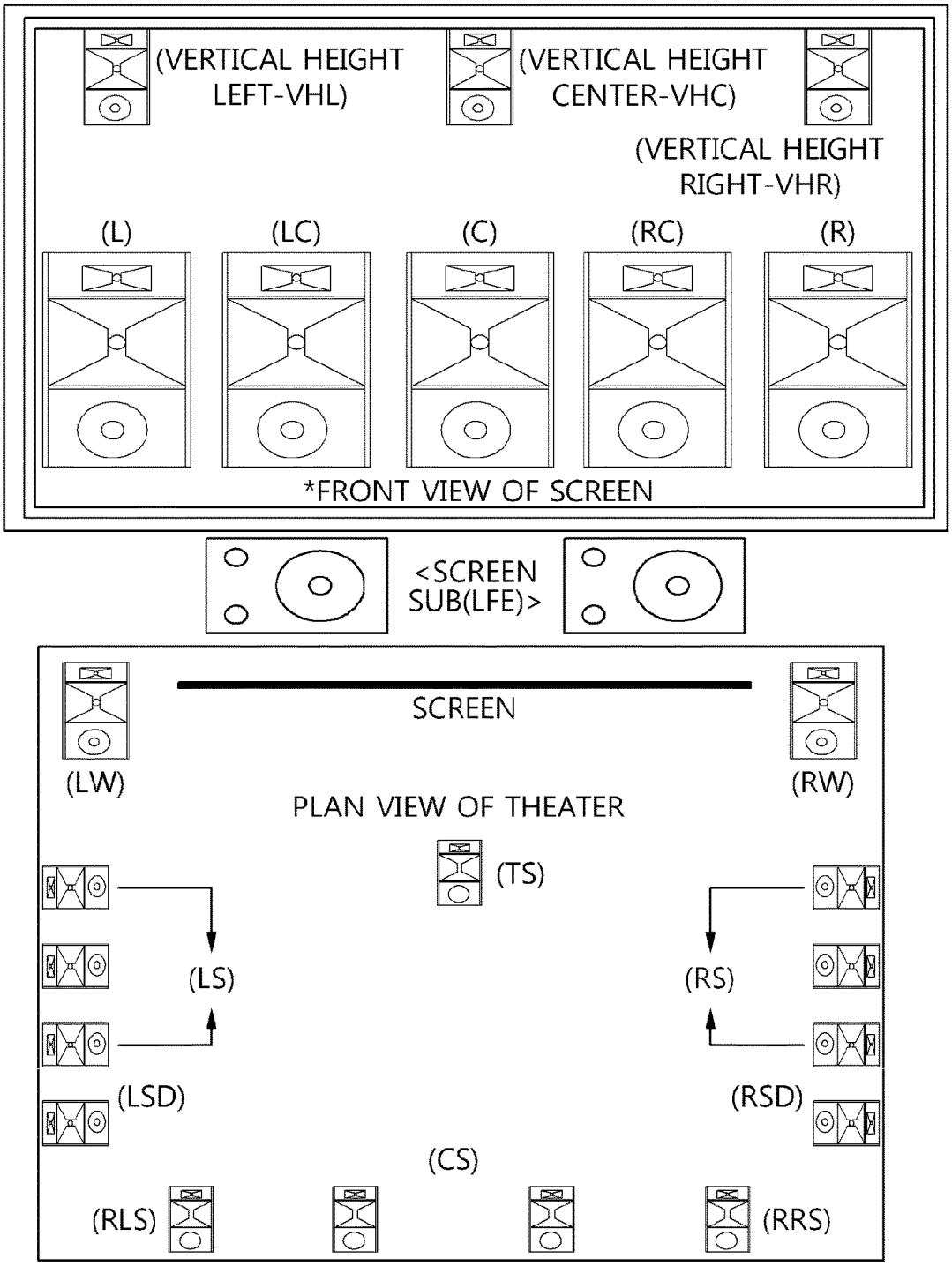
FIG. 4 is a diagram showing another example of a high-multichannel sound system.

FIG. 4 is a diagram showing another example of a high-multichannel sound system.

Referring to FIG. 4, it can be seen that speakers corresponding to 16 or more channels are arranged on a screen side, left and right sides, a rear side, and a ceiling.

A left (L) channel in front of a screen corresponds to the leftmost loudspeaker behind the screen on the basis of an auditorium.

A center (C) channel in front of the screen corresponds to a center loudspeaker behind the screen on the basis of the auditorium.

A right (R) channel in front of the screen corresponds to the rightmost loudspeaker behind the screen on the basis of the auditorium.

Screen sub (LFE) channels below the screen correspond to bandwidth-limited low frequency-dedicated loudspeakers located at an end of the screen.

Left surround (LS) channels on the left side of the auditorium correspond to sets of loudspeaker located along a left wall between the screen and a rear wall facing the theater screen.

Right surround (RS) channels on the right side of the auditorium correspond to sets of loudspeakers located along a right wall between the screen and the rear wall facing the theater screen.

Center Surround (CS) channels correspond to sets of loudspeakers located at the center of the rear wall facing the screen.

A left center (LC) channel in front of the screen corresponds to a loudspeaker located between the center of the screen and a left end.

A right center (RC) channel screen in front of the screen corresponds to a loudspeaker located between the center and a right end.

A VERTICAL HEIGHT LEFT (VHL), a VERTICAL HEIGHT CENTER (VHC) and a VERTICAL HEIGHT RIGHT (VHR) channels correspond to loudspeakers located at and suspended from the upper end of the screen.

A top center surround (TS) channel corresponds to a loudspeaker located at a horizontal and vertical center above the auditorium.

A left wide (LW) channel corresponds to a loudspeaker exposed on the left side of the screen.

A right wide (RW) channel corresponds to a loudspeaker exposed on the right side of the screen.

A rear left surround (RLS) channel corresponds to a loudspeaker on the left side of a rear wall facing the screen.

A rear right surround (RRS) channel corresponds to a loudspeaker on the right side of the rear wall facing the screen.

In addition to the channels shown in FIG. 4, channels (HI and VI-N channels) for visually impaired persons and hearing-impaired persons and a channel for motion data, such as D-Box, may be provided.

As described in conjunction with FIGS. 3 and 4, the realistic 3D audio systems require a large number of channels equal to or more than 16 channels, and must consider compatibility not only with high-multichannel audio systems but also with conventional audio systems, such as a 5.1 channel system, during the packaging of digital audio packets that are used to provide high-multichannel audio.

In particular, decoding or decompressing transmitted data and output sounds is not a heavy load in a theater in which high-multichannel audio system equipment has been installed because expensive equipment has been installed, whereas performing decoding or decompression for audio output may be a heavy load in a theater in which only a conventional sound system, such as a 5.1 channel system, has been installed.

Accordingly, the present invention enables the generation of optimum audio data packets to be achieved by recording direct audio channel data, such as 5.1 channel data, in channel containers without compression and reducing the amount of indirect audio channel data corresponding to high-multichannel audio, such as 16 or more channel audio, through compression and then recording the compressed indirect audio channel data in channel containers.

Furthermore, the present invention enables the generation of optimum audio data packets to be achieved by recording uncompressed audio channel data, such as 5.1 channel data, in channel containers without compression and reducing the amount of compressed audio channel data corresponding to high-multichannel audio, such as 16 or more channel audio, through compression and then recording the compressed indirect audio channel data in channel containers.

FIG. 5 is a table showing the case of encoding 5.1 channel sound into a digital audio packet including 16 channel containers.

Referring to FIG. 5, it can be seen that 5.1 channel sound can be transmitted using only 6 channel containers in a digital audio packet including 16 channel containers.

Since the 5.1 channel sound corresponds to channels (direct audio channels) that are mapped to physical channels in a 1:1 correspondence, channels (indirect audio channels) that are not mapped to physical channels in a 1:1 correspondence may be assigned to the remaining 10 channel containers.

In this case, each of the physical channels refers to a channel used in a theater sound system, and may correspond to a single loudspeaker or a plurality of loudspeakers. That is, an audio channel with which a theater provided with a digital audio packet can immediately output sound is a direct audio channel, and an audio channel with which a theater must perform decoding or decompression to output sound is an indirect audio channel.

Furthermore, since the 5.1 channel sound corresponds to channels (uncompressed audio channels) that are mapped to physical channels in a 1:1 correspondence and are kept uncompressed, channels (compressed audio channels) generated by compressing pieces of audio channel data corresponding to respective physical channels may be assigned to the remaining 10 channel containers.

That is, an audio channel with which a theater provided with a digital audio packet can immediately output sound without a decompression or decoding operation is an uncompressed audio channel, and an audio channel with which a theater must perform decoding or decompression to output sound is a compressed audio channel.

FIG. 6 is a table showing the case of encoding 7.1 channel sound into a digital audio packet including 16 channel containers.

Referring to FIG. 6, it can be seen that 7.1 channel sound can be transmitted using only 8 channel containers in a digital audio packet including 16 channel containers.

Since 7.1 channel sound corresponds to channels (direct audio channels) that are mapped to physical channels in a 1:1 correspondence, channels (indirect audio channels) that are not mapped to physical channels in a 1:1 correspondence may be assigned to the remaining 8 channel containers.

Furthermore, since 7.1 channel sound corresponds to channels (uncompressed audio channels) that are mapped to physical channels in a 1:1 correspondence and are kept uncompressed, channels (compressed audio channels) generated by compressing pieces of audio channel data corresponding to respective physical channels may be assigned to the remaining 8 channel containers.

FIG. 7 is a table showing the case of encoding 5.1 channel sound, 7.1 channel SDDS and 7.1 channel DS into a digital audio packet including 16 channel containers.

Referring to FIG. 7, it can be seen that 9 channel containers are used in the case of providing 5.1 channel, HI/VI and motion data, 11 channel containers are used in the case of providing 7.1 channel SDDS, HI/VI and motion data, and 11 channel containers are used in the case of providing 7.1 channel DS, HI/VI and motion data.

More specifically, in the case of providing 5.1 channels, HI/VI and motion data, 6 pieces of 5.1 channel audio data may be contained and transmitted in channel containers 1 to 6 in the sequence of L, R, C, LFE, Ls and Rs, the HI and VI channels, i.e., channels for hearing-impaired persons and visually impaired persons, may be contained and transmitted in channel containers 7 and 8, and a channel for motion data may be contained and transmitted in channel container 13. In this case, channel containers for containing indirect audio channel data (or compressed audio channel data) may be any one or more of channel containers 9 to 12 and 14 to 16. Furthermore, in an embodiment, one or more of channels for providing HI/VI and motion data may be omitted, in which case channel containers corresponding to the omitted channels may be assigned for indirect audio channel data (or compressed audio channel data).

In the case of providing 7.1 channel SDDS, HI/VI and motion data, 8 pieces of 7.1 channel SDDS audio data may be contained and transmitted in channel containers 1 to 6 and 9 to 10 in the sequence of L, R, C, LFE, Ls, Rs, Lc and Rc, HI and VI channels, i.e., channels for hearing-impaired persons and visually impaired persons, may be contained and transmitted in channel containers 7 and 8, and a channel for the motion data may be contained and transmitted in channel container 13. In this case, channel containers for containing indirect audio channel data (or compressed audio channel data) may be any one or more of channel containers 11 to 12 and 14 to 16. Furthermore, in an embodiment, one or more of the channels for providing HI/VI and motion data may be omitted, in which case channel containers corresponding to the omitted channels may be assigned for indirect audio channel data (compressed audio channel data).

In the case of providing 7.1 channel DS, HI/VI and motion data, 8 pieces of 7.1 channel DS audio data may be contained and transmitted in channel containers 1 to 6, 11 and 12 in the sequence of L, R, C, LFE, Lss, Rss, Lrs and Rrs, HI and VI channels, i.e., channels for hearing-impaired persons and visually impaired persons, may be contained and transmitted in channel containers 7 and 8, and a channel for motion data may be contained and transmitted in channel container 13. In this case, channel containers for containing indirect audio channel data (compressed audio channel data) may be any one or more of channel containers 9, 10 and 14 to 16. Furthermore, in an embodiment, one or more of the channels for providing HI/VI and motion data may be omitted, in which case channel containers corresponding to the omitted channels may be assigned for indirect audio channel data (compressed audio channel data).

As shown in FIG. 7, all the assigned channel containers directly correspond to physical channels in a in a one-to-one correspondence in a decoding stage, such as a theater sound system or the like, and thus correspond to direct audio channel data. Furthermore, all the assigned channel containers are maintained in the state of being uncompressed so that they can directly correspond to physical channels in a in a one-to-one correspondence in a decoding stage, such as a theater sound system or the like, and thus correspond to uncompressed audio channel data.

FIG. 8 is a table showing the case of encoding high-multichannel audio channel data, together with 5.1 channel sound or 7.1 channel sound, into a digital audio packet including 16 channel containers.

Referring to FIG. 8, it can be seen that 8 channel containers are used in the case of providing 5.1 channels and HI/VI and 10 channel containers are used in the case of providing 7.1 channel DS and HI/VI.

More specifically, in the case of providing 5.1 channels and HI/VI, 6 pieces of 5.1 channel audio data may be contained and transmitted in channel containers 1 to 6 in the sequence of L, R, C, LFE, Ls and Rs, and HI and VI channels, i.e., channels for hearing-impaired persons and visually impaired persons, may be contained and transmitted in channel containers 7 and 8. In this case, channel containers for containing indirect audio channel data (or compressed audio channel data) may be any one or more of channel containers 9 to 16.

Furthermore, in the case of providing 7.1 channel DS and HI/VI, 8 pieces of 7.1 channel DS audio data may be contained and transmitted in channel containers 1 to 6 and 11 to 12 in the sequence of L, R, C, LFE, Lss, Rss, Lrs and Rrs, and HI and VI channels, i.e., channels for hearing-impaired persons and visually impaired persons, may be contained and transmitted in channel containers 7 and 8. In this case, channel containers for containing indirect audio channel data (compressed audio channel data) may be any one or more of channel containers 9, 10, and 13 to 16.

Pieces of audio channel data that are indirectly mapped to respective physical channels are assigns to channel containers to which indirect direct audio channel data has not been assigned. Furthermore, pieces of compressed audio channel data generated by compressing pieces of audio channel data corresponding to respective physical channel are assigned to channel containers to which uncompressed audio channel data has not been assigned.

In the example shown in FIG. 8, it can be seen that 6 pieces of indirect audio channel data (or compressed audio channel data) (STA Channel 1, STA Channel 2, STA Channel 3, STA Channel 4, STA Channel 5, an STA Channel 6) have been assigned to channel containers 9, 10, 13, 14, 15 and 16, i.e., channel containers to which direct audio channel data (uncompressed audio channel data) has not been assigned.

As described above, according to the present invention, a digital audio packet is generated using not only direct audio channel data (uncompressed audio channel data) not requiring decoding or compression but also indirect audio channel data (compressed audio channel data) enabling high-multichannel audio data to be contained in a relatively small number of channel containers via decoding or compression using high-end hardware, and thus backward compatibility can be ensured and also realistic 3D sound can be effectively provided.

In this case, the digital audio packet is a set of pieces of digital data, and may correspond to a bundle of packets, frames or pieces of data.

Figure 9:
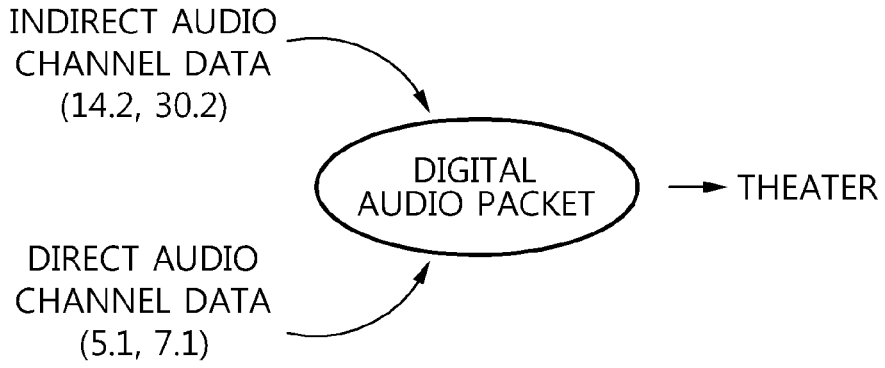
FIG. 9 is a conceptual diagram showing a method of coding scalable digital audio according to an embodiment of the present invention.

FIG. 9 is a conceptual diagram showing a method of coding scalable digital audio according to an embodiment of the present invention.

Referring to FIG. 9, it can be seen that the method of coding scalable digital audio according to the present embodiment of the present invention generates a digital audio packet using both direct audio channel data recorded in a form not requiring decoding or decompression in a decoding stage and indirect audio channel data adapted to need to generate a number of pieces of audio channel data more than the number of assigned channel containers via decoding or decompression in the decoding stage and provides the generated digital audio packet to a theater or the like.

As described above, both direct audio channel data and indirect audio channel data are all included in a single digital audio packet, and thus optimum backward compatibility can be achieved and also 16 or higher-channel realistic 3D sound can be provided.

Figure 10:
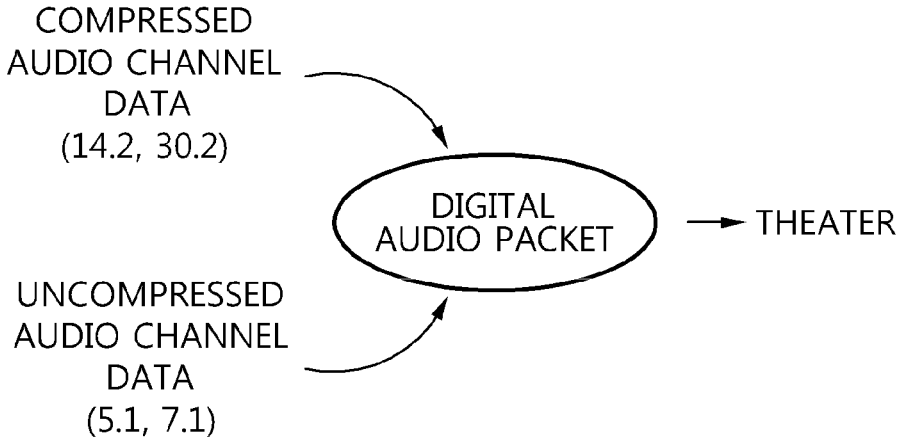
FIG. 10 is a conceptual diagram showing a method of coding scalable digital audio according to another embodiment of the present invention.

FIG. 10 is a conceptual diagram showing a method of coding scalable digital audio according to another embodiment of the present invention.

Referring to FIG. 10, the method of coding scalable digital audio according to the present embodiment of the present invention generates a digital audio packet using both uncompressed audio channel data recorded in a form not requiring decoding or decompression in a decoding stage but also compressed audio channel data adapted to need to generate a number of pieces of audio channel data more than the number of assigned channel containers via decoding or decompression in the decoding stage and provides the generated digital audio packet to a theater or the like.

As described above, both uncompressed audio channel data and compressed audio channel data are all included in a single digital audio packet, and thus optimum backward compatibility can be achieved and also 16 or higher-channel realistic 3D sound can be provided.

Figure 11:
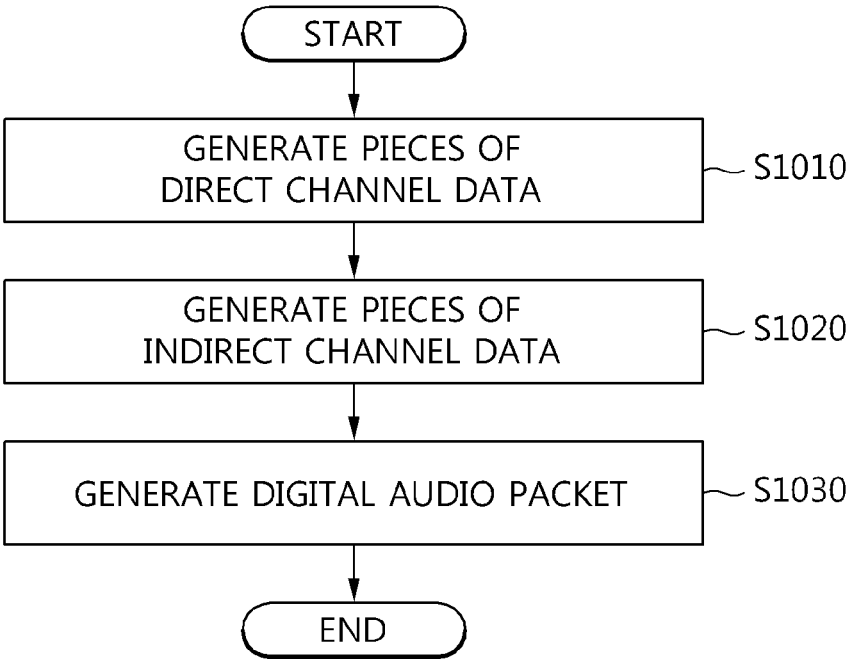
FIG. 11 is an operation flowchart showing a method of coding scalable digital audio according to an embodiment of the present invention.

FIG. 11 is an operation flowchart showing a method of coding scalable digital audio according to an embodiment of the present invention.

Referring to FIG. 11, in the method of coding scalable digital audio according to the present embodiment of the present invention, pieces of direct audio channel data that are mapped to respective physical channels in a one-to-one correspondence are generated at step S1010.

In this case, the physical channels refer to channels that are used for sound output in a theater. For example, the physical channels may be 6 channels, i.e., L, R, C, LFE, Ls and Rs channels, in the case of a 5.1 channel sound system, and may be 8 channels, i.e., L, R, C, LFE, Ls, Rs, Lc and Rc channels, in the case of a 7.1 channel sound system.

That is, the pieces of direct audio channel data may be pieces of data corresponding to L, R, C, LFE, Ls and Rs channels in a 5.1 channel sound system, and may be pieces of data corresponding to L, R, C, LFE, Ls, Rs, Lc and Rc channels in the case of a 7.1 channel sound system.

In this case, the pieces of direct audio channel data may be pulse code modulated wave files, and may be maintained in the state of being uncompressed while the digital audio packet is being packaged, distributed, and stored.

Furthermore, in the method of coding scalable digital audio according to the present embodiment of the present invention, pieces of indirect audio channel data that are synchronized with video sources corresponding to the respective pieces of direct audio channel data and that are indirectly mapped to respective physical channels are generated at step S1020.

In this case, the number of pieces of indirect audio channel data may be less than the number of physical channels corresponding to the pieces of indirect audio channel data.

For example, the pieces of indirect audio channel data may have been compressed such that original 32 (the number of physical channels) pieces of channel audio data can be contained in 6 (the number of pieces of indirect audio channel data) channels.

Furthermore, in the method of coding scalable digital audio according to the present embodiment of the present invention, a digital audio packet is generated using the pieces of direct audio channel data and the pieces of indirect audio channel data at step S1030.

In this case, the digital audio packet may include a plurality of channel containers each adapted to record digital audio channel data. Each of the pieces of direct audio channel data and the pieces of indirect audio channel data may be mapped to one of the plurality of channel containers in a one-to-one correspondence.

In this case, the pieces of indirect audio channel data may be recorded in at least part of the remainder of the channel containers in which the pieces of direct audio channel data have not been recorded.

In this case, the pieces of indirect audio channel data may be compressed in order to be recorded in a number of channel containers less than the number of physically required channel containers, and then may be recorded in the at least part of the remainder.

In this case, the digital audio packet may include 16 channel containers, the number of pieces of direct audio channel data may be equal to or more than 6 and equal to or less than 11, and the number of pieces of indirect audio channel data may be 6.

In this case, the number of pieces of direct audio channel data may be even. As described above, the number of corresponding channel containers may be made even by providing an even number of pieces of direct audio channel data, and thus an AES pair may be formed.

In this case, the pieces of indirect audio channel data may correspond to high-multichannel audio sources for a theater, which are equal to or more than 16 channels and equal to or fewer than 256 channels.

In this case, the method of coding scalable digital audio, which is shown in FIG. 11, may provide channel assignment information corresponding to the digital audio packet, together with the digital audio packet, so that the channel assignment information can be considered when the digital audio packet is decoded in a decoding stage.

Figure 12:
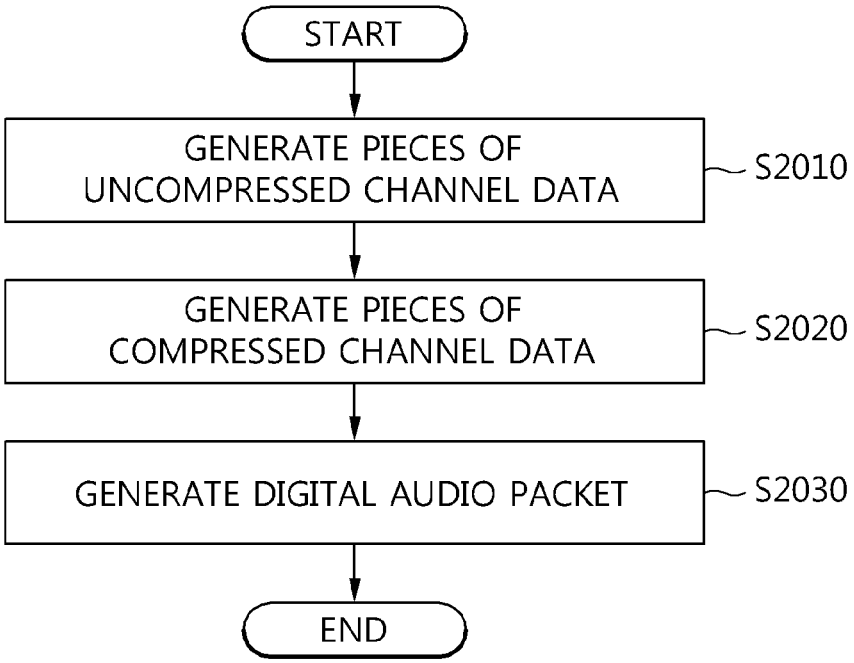
FIG. 12 is an operation flowchart showing a method of coding scalable digital audio according to another embodiment of the present invention.

FIG. 12 is an operation flowchart showing a method of coding scalable digital audio according to another embodiment of the present invention.

Referring to FIG. 12, in the method of coding scalable digital audio according to the present embodiment of the present invention, a plurality of pieces of uncompressed audio channel data that is maintained in the state of being uncompressed is generated at step S2010.

In this case, physical channels refer to channels that are used for sound output in a theater. For example, the physical channels may be 6 channels, i.e., L, R, C, LFE, Ls and Rs channels, in the case of a 5.1 channel sound system, and may be 8 channels, i.e., L, R, C, LFE, Ls, Rs, Lc and Rc channels, in the case of a 7.1 channel sound system.

That is, the pieces of uncompressed audio channel data may be pieces of data corresponding to L, R, C, LFE, Ls and Rs channels in the case of a 5.1 channel sound system, and may be pieces of data corresponding to L, R, C, LFE, Ls, Rs, Lc and Rc channels in the case of a 7.1 channel sound system.

In this case, the pieces of uncompressed audio channel data may be respective pulse code modulated wave files, and may be maintained in the state of being uncompressed while the digital audio packet is being packaged, distributed, and stored.

Furthermore, in the method of coding scalable digital audio according to the present embodiment of the present invention, pieces of compressed audio channel data that are synchronized with video sources corresponding to the pieces of uncompressed audio channel data and that are generated by compressing pieces of audio channel data corresponding to respective physical channels are generated at step S2020.

In this case, the number of pieces of compressed audio channel data may be less than the number of physical channels corresponding to the pieces of compressed audio channel data.

For example, the pieces of compressed audio channel data may be have been compressed such that original 32 (the number of physical channels) pieces of channel audio data can be contained in 6 (the number of pieces of compressed audio channel data) channels.

Furthermore, in the method of coding scalable digital audio according to the present embodiment of the present invention, a digital audio packet is generated using the pieces of uncompressed audio channel data and the pieces of compressed audio channel data at step S2030.

In this case, the digital audio packet may include a plurality of channel containers each adapted to record digital audio channel data. Each of the pieces of uncompressed audio channel data and the pieces of compressed audio channel data may be mapped to one of the plurality of channel containers in a one-to-one correspondence.

In this case, the pieces of compressed audio channel data may be recorded in at least part of the remainder of the channel containers in which the pieces of uncompressed audio channel data have not been recorded.

In this case, the pieces of compressed audio channel data may be compressed in order to be recorded in a number of channel containers less than the number of physically required channel containers, and then may be recorded in the at least part of the remainder.

In this case, the digital audio packet may include 16 channel containers, the number of pieces of uncompressed audio channel data may be equal to or more than 6 and equal to or less than 11, and the number of pieces of compressed audio channel data may be 6.

In this case, the number of pieces of uncompressed audio channel data may be even. As described above, the number of corresponding channel containers may be made even by providing an even number of pieces of uncompressed audio channel data, and thus an AES pair may be formed.

In this case, the pieces of compressed audio channel data may correspond to high-multichannel audio sources for a theater, which are equal to or more than 16 channels and equal to or fewer than 256 channels.

In this case, the method of coding scalable digital audio, which is shown in FIG. 12, may provide channel assignment information corresponding to the digital audio packet, together with the digital audio packet, so that the channel assignment information can be considered when the digital audio packet is decoded in a decoding stage.

FIGS. 13 to 16 are operation flowcharts showing methods of decoding scalable digital audio according to embodiments of the present invention.

Figure 13:
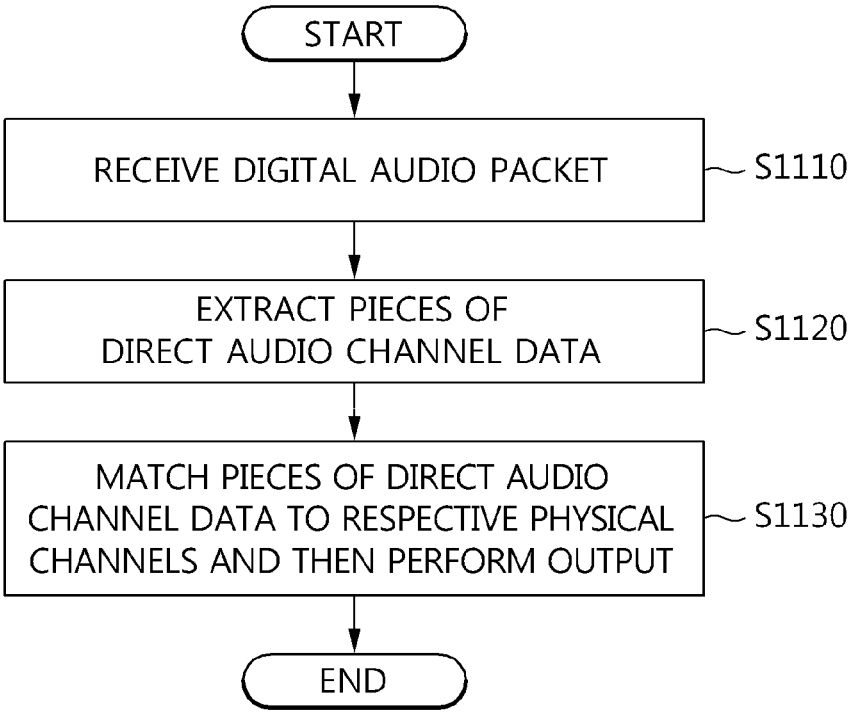
FIGS. 13 to 16 are operation flowcharts showing methods of decoding scalable digital audio according to embodiments of the present invention.

Referring to FIG. 13, in the method of decoding scalable digital audio according to an embodiment of the present invention, a digital audio packet, including a plurality of pieces of direct audio channel data mapped to respective physical channels in a one-to-one correspondence and a plurality of pieces of indirect audio channel data indirectly mapped to respective physical channels, is received at step S1110.

Furthermore, in the method of decoding scalable digital audio, the pieces of direct audio channel data are extracted from the digital audio packet at step S1120.

Furthermore, in the method of decoding scalable digital audio, the pieces of direct audio channel data are matched to the respective physical channels in a one-to-one correspondence and are then output at step S1130.

Figure 14:
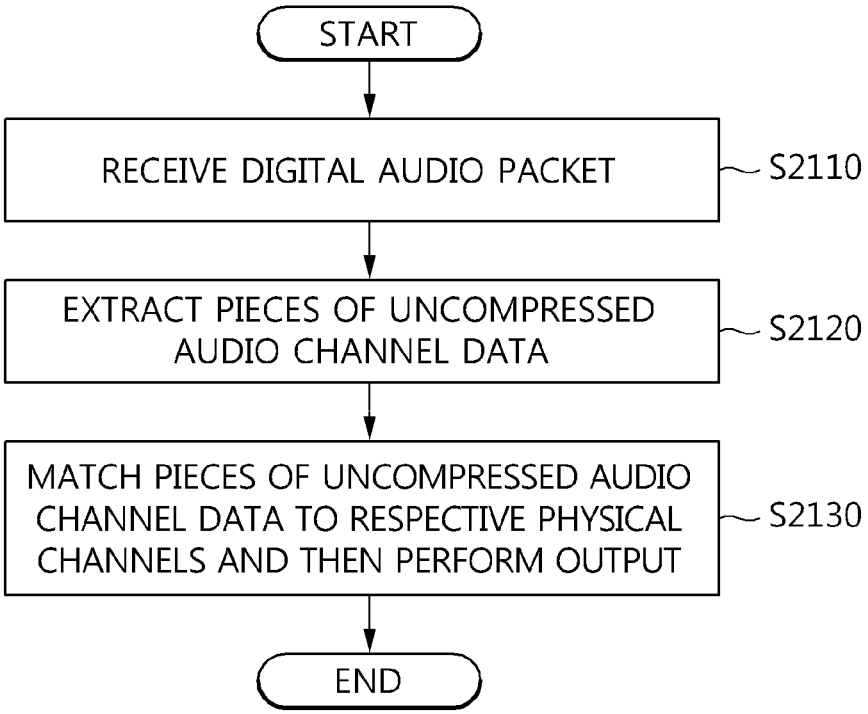

Referring to FIG. 14, in the method of decoding scalable digital audio according to an embodiment of the present invention, a digital audio packet, including a plurality of pieces of uncompressed audio channel data maintained in the state of being uncompressed and a plurality of pieces of compressed audio channel data generated by compressing pieces of audio channel data corresponding to respective physical channels, is received at step S2110.

Furthermore, in the method of decoding scalable digital audio, the pieces of uncompressed audio channel data are extracted from the digital audio packet at step S2120.

Furthermore, in the method of decoding scalable digital audio, the pieces of uncompressed audio channel data are matched to the respective physical channels in a one-to-one correspondence and are then output at step S2130.

Figure 15:
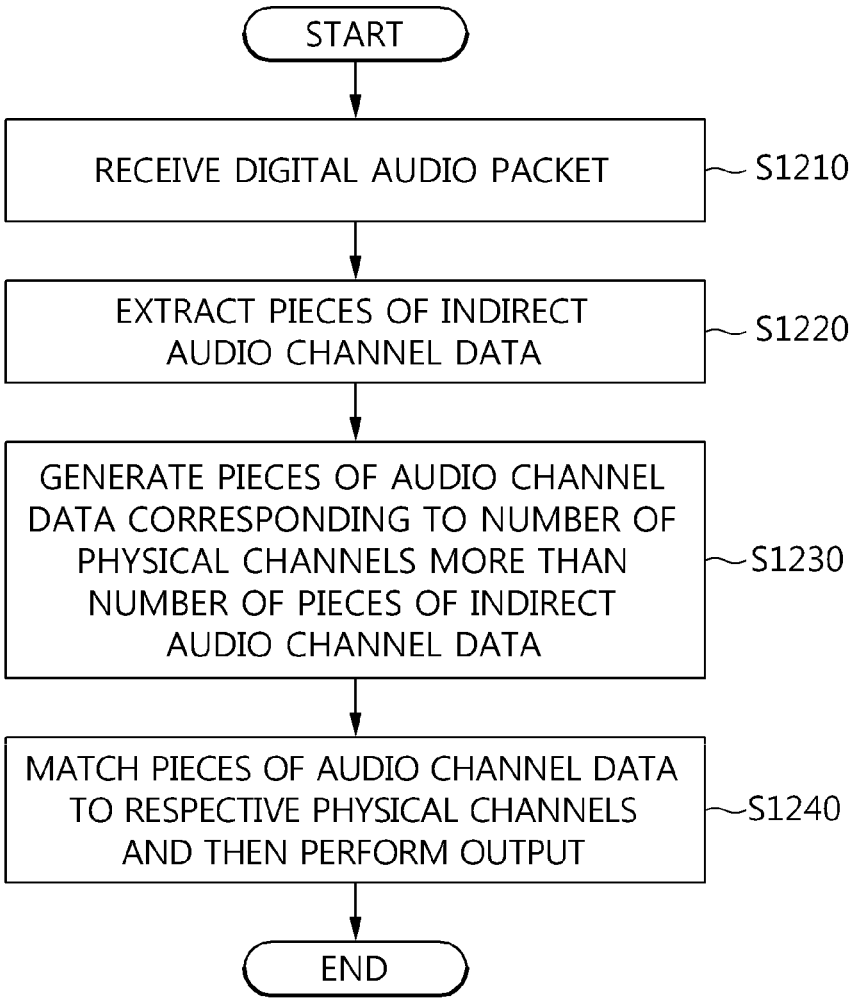

Referring to FIG. 15, in the method of decoding scalable digital audio according to an embodiment of the present invention, a digital audio packet, including a plurality of pieces of direct audio channel data mapped to respective physical channels in a one-to-one correspondence and a plurality of pieces of indirect audio channel data indirectly mapped to respective physical channels, is received at step S1210.

Furthermore, in the method of decoding scalable digital audio, the pieces of indirect audio channel data are extracted from the digital audio packet at step S1220.

Furthermore, in the method of decoding scalable digital audio, pieces of audio channel data corresponding to a number of physical channels more than the number of pieces of indirect audio channel data are generated using the pieces of indirect audio channel data at step S1230.

In this case, at step S1230, the pieces of audio channel data corresponding to a number of physical channels more than the number of pieces of indirect audio channel data may be generated by performing a decompression process on the pieces of indirect audio channel data.

In this case, the pieces of audio channel data may be output as respective audio outputs of a high-multichannel audio system for a theater, which are equal to or more than 16 channels and equal to or fewer than 256 channels.

Furthermore, in the method of decoding scalable digital audio, the pieces of audio channel data are matched to the physical channels in a one-to-one correspondence and are then output at step S1240.

Figure 16:
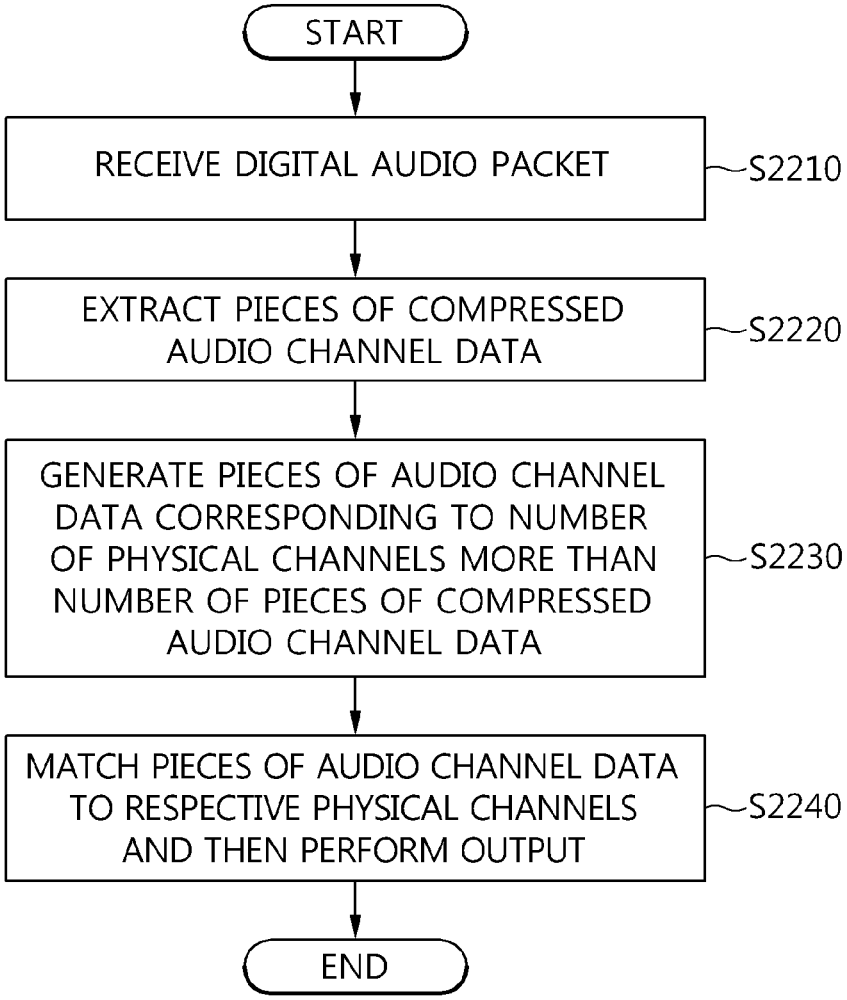

Referring to FIG. 16, in the method of decoding scalable digital audio according to an embodiment of the present invention, a digital audio packet, including a plurality of pieces of uncompressed audio channel data maintained in the state of being uncompressed and a plurality of pieces of compressed audio channel data generated by compressing pieces of audio channel data corresponding to respective physical channels, is received at step S2210.

Furthermore, in the method of decoding scalable digital audio, the pieces of compressed audio channel data are extracted from the digital audio packet at step S2220.

Furthermore, in the method of decoding scalable digital audio, the pieces of audio channel data corresponding to a number of physical channels more than the number of pieces of compressed audio channel data are generated using the pieces of compressed audio channel data at step S2230.

In this case, at step S2230, the pieces of audio channel data corresponding to a number of physical channels more than the number of pieces of compressed audio channel data may be generated by performing a decompression process on the pieces of compressed audio channel data.

In this case, the pieces of audio channel data may be output as respective audio outputs of a high-multichannel audio system for a theater, which are equal to or more than 16 channels and equal to or fewer than 256 channels.

Furthermore, in the method of decoding scalable digital audio, the pieces of audio channel data are matched to the respective physical channels in a one-to-one correspondence and are then output at step S2240.

In the methods of decoding scalable digital audio, which are shown in FIGS. 13 to 16, the pieces of direct audio channel data (the pieces of compressed audio channel data) may be pulse code modulated wave files, and may be maintained in the state of being uncompressed while the digital audio packet is being packaged, distributed, and stored.

In the methods of decoding scalable digital audio, which are shown in FIGS. 13 to 16, the digital audio packet may include a plurality of channel containers used to record digital audio channel data. Each of the pieces of direct audio channel data (the pieces of uncompressed audio channel data) and the pieces of indirect audio channel data (the pieces of compressed audio channel data) may be mapped to one of the plurality of channel containers in a one-to-one correspondence.

In this case, the pieces of indirect audio channel data (the pieces of compressed audio channel data) may be recorded in at least part of the remainder of the channel containers in which the pieces of direct audio channel data (the pieces of uncompressed audio channel data) have not been recorded.

In this case, the digital audio packet may include 16 channel containers, the number of pieces of direct audio channel data (the pieces of uncompressed audio channel data) is equal to or more than 6 and equal to or less than 11, and the number of pieces of indirect audio channel data (the number of pieces of compressed audio channel data) may be 6.

In this case, the number of pieces of direct audio channel data (the number of pieces of uncompressed audio channel data) may be even.

Although not shown in FIGS. 13 to 16, the method of decoding scalable digital audio may further include the step of receiving channel assignment information corresponding to the digital audio packet. In this case, step S1230 or S2230 shown in FIG. 15 or 16 may be performed based on the channel assignment information.

Figure 17:
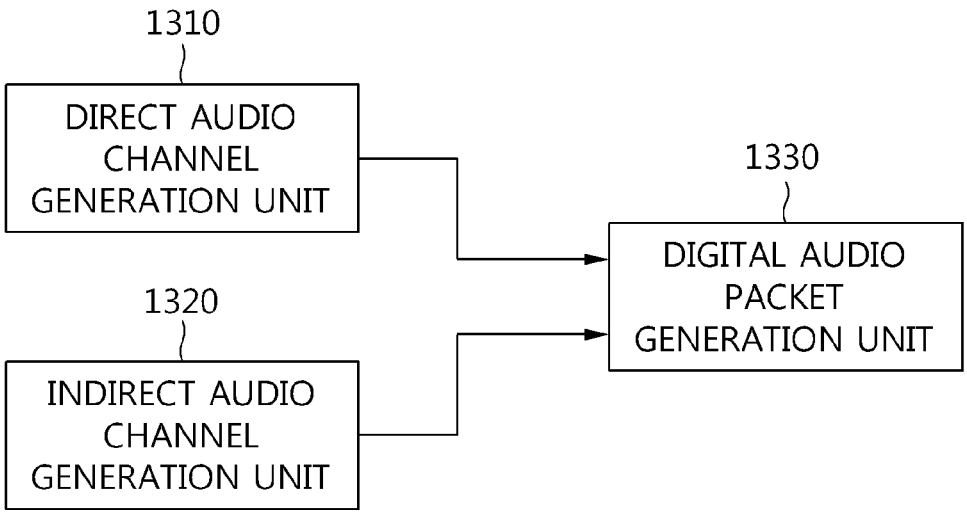
FIG. 17 is a block diagram showing an apparatus for coding scalable digital audio according to an embodiment of the present invention.

FIG. 17 is a block diagram showing an apparatus for coding scalable digital audio according to an embodiment of the present invention.

Referring to FIG. 17, the apparatus for coding scalable digital audio according to the present embodiment of the present invention includes a direct audio channel generation unit 1310, an indirect audio channel generation unit 1320, and a digital audio packet generation unit 1330.

The direct audio channel generation unit 1310 generates a plurality of pieces of direct audio channel data mapped to respective physical channels in a one-to-one correspondence.

In this case, the pieces of direct audio channel data may be pulse code modulated wave files, and may be maintained in the state of being uncompressed while the digital audio packet is being packaged, distributed, and stored.

In this case, the number of pieces of direct audio channel data may be even.

The indirect audio channel generation unit 1320 generates pieces of indirect audio channel data that are synchronized with video sources corresponding to the pieces of direct audio channel data and that are indirectly mapped to respective physical channels.

In this case, the number of pieces of indirect audio channel data may be less than the number of physical channels corresponding to the pieces of indirect audio channel data.

In this case, the pieces of indirect audio channel data may correspond to high-multichannel audio sources for a theater, which are equal to or more than 16 channels and equal to or fewer than 256 channels.

The digital audio packet generation unit 1330 generates a digital audio packet using the pieces of direct audio channel data and the pieces of indirect audio channel data.

In this case, the digital audio packet may include a plurality of channel containers each adapted to record digital audio channel data. Each of the pieces of direct audio channel data and the pieces of indirect audio channel data may be mapped to one of the plurality of channel containers in a one-to-one correspondence.

In this case, the pieces of indirect audio channel data may be recorded in at least part of the remainder of the channel containers in which the pieces of direct audio channel data have not been recorded.

In this case, the pieces of indirect audio channel data may be compressed in order to be recorded in a number of channel containers less than the number of physically required channel containers, and then may be recorded in the at least part of the remainder.

In this case, the digital audio packet may include 16 channel containers, the number of pieces of direct audio channel data may be equal to or more than 6 and equal to or less than 11, and the number of pieces of indirect audio channel data may be 6.

In this case, the apparatus for coding scalable digital audio, which is shown in FIG. 17, may provide channel assignment information corresponding to the digital audio packet, together with the digital audio packet, so that the channel assignment information can be considered when the digital audio packet is decoded in a decoding stage.

Figure 18:
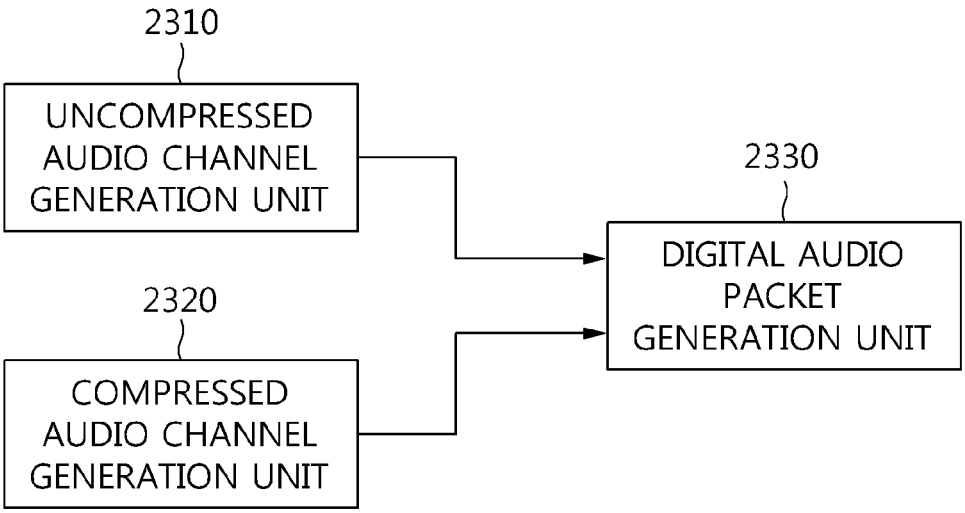
FIG. 18 is a block diagram showing an apparatus for coding scalable digital audio according to another embodiment of the present invention.

FIG. 18 is a block diagram showing an apparatus for coding scalable digital audio according to another embodiment of the present invention.

Referring to FIG. 18, the apparatus for coding scalable digital audio according to an embodiment of the present invention includes an uncompressed audio channel generation unit 2310, a compressed audio channel generation unit 2320, and a digital audio packet generation unit 2330.

The uncompressed audio channel generation unit 2310 generates a plurality of pieces of uncompressed audio channel data that is maintained in the state of being uncompressed.

In this case, the pieces of uncompressed audio channel data may be pulse code modulated wave files, and may be maintained in the state of being uncompressed while the digital audio packet is being packaged, distributed, and stored.

In this case, the number of pieces of uncompressed audio channel data may be even.

The compressed audio channel generation unit 2320 generates pieces of compressed audio channel data that are synchronized with video sources corresponding to the pieces of uncompressed audio channel data and that are generated by compressing pieces of audio channel data corresponding to respective physical channels.

In this case, the number of pieces of compressed audio channel data may be less than the number of physical channels corresponding to the pieces of compressed audio channel data.

In this case, the pieces of compressed audio channel data may correspond to high-multichannel audio sources for a theater, which are equal to or more than 16 channels and equal to or fewer than 256 channels.

The digital audio packet generation unit 2330 generates a digital audio packet using the pieces of uncompressed audio channel data and the pieces of compressed audio channel data.

In this case, the digital audio packet may include a plurality of channel containers each adapted to record digital audio channel data. Each of the pieces of uncompressed audio channel data and the pieces of compressed audio channel data may be mapped to one of the plurality of channel containers in a one-to-one correspondence.

In this case, the pieces of compressed audio channel data may be recorded in at least part of the remainder of the channel containers in which the pieces of uncompressed audio channel data have not been recorded.

In this case, the pieces of compressed audio channel data may be compressed in order to be recorded in a number of channel containers less than the number of physically required channel containers, and then may be recorded in the at least part of the remainder.

In this case, the digital audio packet may include 16 channel containers, the number of pieces of uncompressed audio channel data may be equal to or more than 6 and equal to or less than 11, and the number of pieces of compressed audio channel data may be 6.

In this case, the apparatus for coding scalable digital audio, which is shown in FIG. 18, may provide channel assignment information corresponding to the digital audio packet, together with the digital audio packet, so that the channel assignment information can be considered when the digital audio packet is decoded in a decoding stage.

Figure 19:
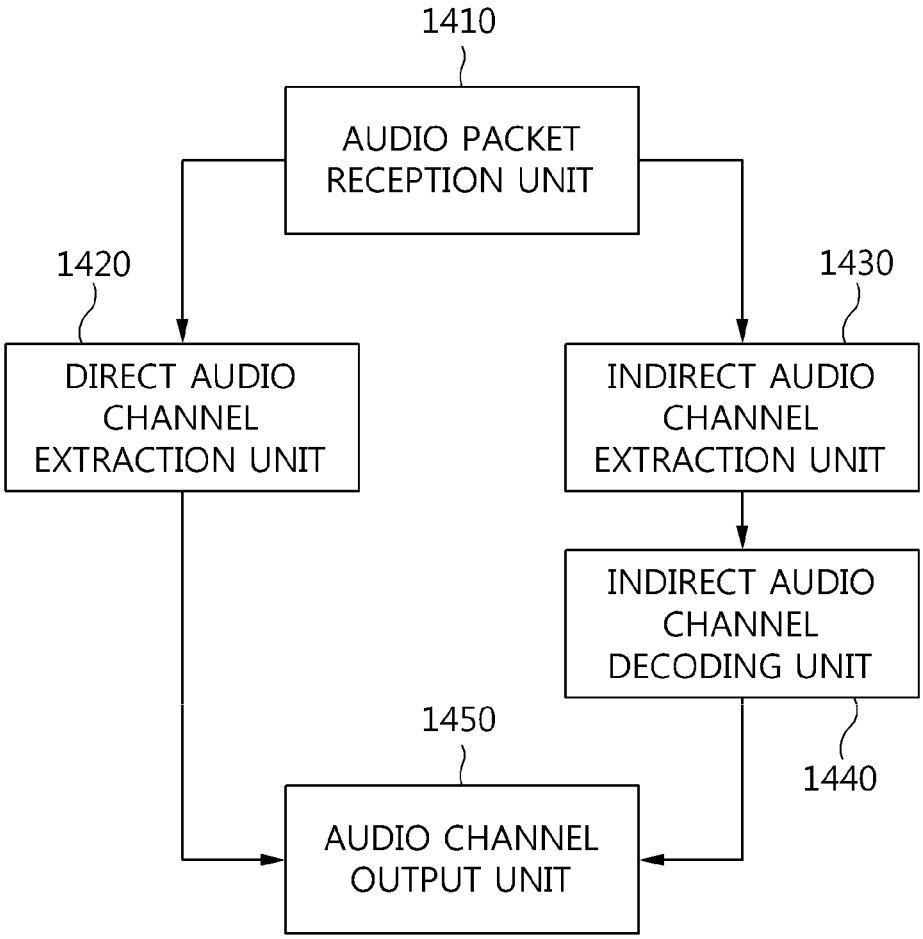
FIG. 19 is a block diagram showing an apparatus for decoding scalable digital audio according to an embodiment of the present invention.

FIG. 19 is a block diagram showing an apparatus for decoding scalable digital audio according to an embodiment of the present invention.

Referring to FIG. 19, the apparatus for decoding scalable digital audio according to the present embodiment of the present invention includes an audio packet reception unit 1410, a direct audio channel extraction unit 1420, an indirect audio channel extraction unit 1430, an indirect audio channel decoding unit 1440, and an audio channel output unit 1450.

The audio packet reception unit 1410 receives a digital audio packet, including a plurality of pieces of direct audio channel data mapped to respective physical channels in a one-to-one correspondence and a plurality of pieces of indirect audio channel data indirectly mapped to respective physical channels.

In this case, the digital audio packet may include a plurality of channel containers each adapted to record digital audio channel data. Each of the pieces of direct audio channel data and the pieces of indirect audio channel data may be mapped to one of the plurality of channel containers in a one-to-one correspondence.

The direct audio channel extraction unit 1420 extracts the pieces of direct audio channel data from the digital audio packet.

In this case, the pieces of direct audio channel data may be pulse code modulated wave files, and may be maintained in the state of being uncompressed while the digital audio packet is being packaged, distributed, and stored.

In this case, the number of pieces of direct audio channel data may be even.

The indirect audio channel extraction unit 1430 extracts the pieces of indirect audio channel data from the digital audio packet.

In this case, the pieces of indirect audio channel data may be recorded in at least part of the remainder of the channel containers in which the pieces of direct audio channel data have not been recorded.

In this case, the digital audio packet may include 16 channel containers, the number of pieces of uncompressed audio channel data may be equal to or more than 6 and equal to or less than 11, and the number of pieces of compressed audio channel data may be 6.

The indirect audio channel decoding unit 1440 generates pieces of audio channel data corresponding to a number of physical channels more than the number of pieces of indirect audio channel data the pieces of indirect audio channel data.

In this case, the indirect audio channel decoding unit 1440 may generate the pieces of audio channel data corresponding to a number of physical channels more than the number of pieces of indirect audio channel data by performing a decompression process on the pieces of indirect audio channel data.

In this case, the pieces of audio channel data may be output as respective audio outputs of a high-multichannel audio system for a theater, which are equal to or more than 16 channels and equal to or fewer than 256 channels.

The audio channel output unit 1450 matches the pieces of audio channel data to the physical channels in a one-to-one correspondence and then performs output.

Although not shown in FIG. 19, the apparatus for decoding scalable digital audio may further include a channel assignment information reception unit configured to receive channel assignment information corresponding to the digital audio packet. The indirect audio channel decoding unit 1440 may generate the pieces of audio channel data based on the channel assignment information.

Figure 20:
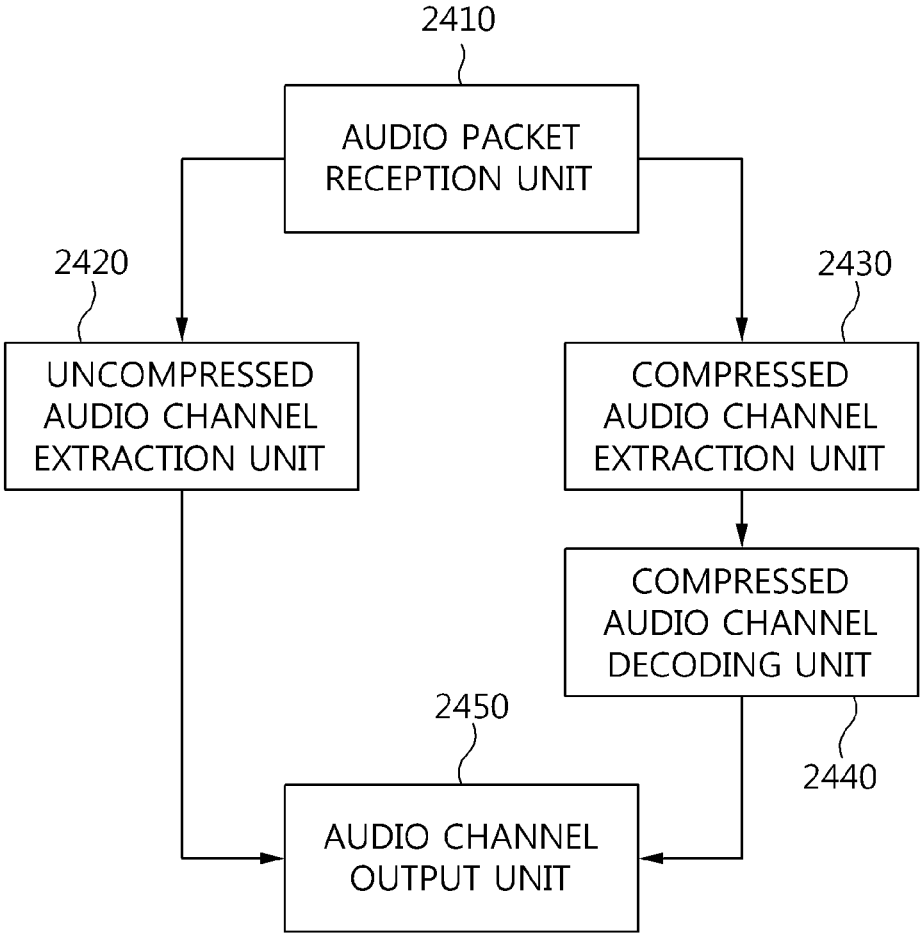
FIG. 20 is a block diagram showing an apparatus for decoding scalable digital audio according to another embodiment of the present invention.

FIG. 20 is a block diagram showing an apparatus for decoding scalable digital audio according to another embodiment of the present invention.

Referring to FIG. 20, the apparatus for decoding scalable digital audio according to an embodiment of the present invention includes an audio packet reception unit 2410, an uncompressed audio channel extraction unit 2420, a compressed audio channel extraction unit 2430, a compressed audio channel decoding unit 2440, and an audio channel output unit 2450.

The audio packet reception unit 2410 receives a digital audio packet, including a plurality of pieces of uncompressed audio channel data maintained in the state of being uncompressed and a plurality of pieces of compressed audio channel data generated by compressing pieces of audio channel data corresponding to respective physical channels.

In this case, the digital audio packet may include a plurality of channel containers each adapted to record digital audio channel data. Each of the pieces of uncompressed audio channel data and the pieces of compressed audio channel data may be mapped to one of the plurality of channel containers in a one-to-one correspondence.

The uncompressed audio channel extraction unit 2420 extracts the pieces of uncompressed audio channel data from the digital audio packet.

In this case, the pieces of uncompressed audio channel data may be pulse code modulated wave files, and may be maintained in the state of being uncompressed while the digital audio packet is being packaged, distributed, and stored.

In this case, the number of pieces of uncompressed audio channel data may be even.

The compressed audio channel extraction unit 2430 extracts the pieces of compressed audio channel data from the digital audio packet.

In this case, the pieces of compressed audio channel data may be recorded in at least part of the remainder of the channel containers in which the pieces of uncompressed audio channel data have not been recorded.

In this case, the digital audio packet may include 16 channel containers, the number of pieces of uncompressed audio channel data may be equal to or more than 6 and equal to or less than 11, and the number of pieces of compressed audio channel data may be 6.

The compressed audio channel decoding unit 2440 generates the pieces of audio channel data corresponding to a number of physical channels more than the number of pieces of compressed audio channel data using the pieces of compressed audio channel data.

In this case, the compressed audio channel decoding unit 2440 may generate the pieces of audio channel data corresponding to a number of physical channels more than the number of pieces of compressed audio channel data by performing a decompression process on the pieces of compressed audio channel data.

In this case, the pieces of audio channel data may be output as respective audio outputs of a high-multichannel audio system for a theater, which are equal to or more than 16 channels and equal to or fewer than 256 channels.

The audio channel output unit 2450 matches the pieces of audio channel data to the physical channels in a one-to-one correspondence and then performs output.

Although not shown in FIG. 20, the apparatus for decoding scalable digital audio may further include a channel assignment information reception unit configured to receive channel assignment information corresponding to the digital audio packet. The compressed audio channel decoding unit 1440 may generate the pieces of audio channel data based on the channel assignment information.

The methods of decoding scalable digital audio and the methods of encoding scalable digital audio according to the present invention may be implemented in the form of program instructions that can be executed by various computer means, and may be recorded on a computer-readable storage medium. The computer-readable storage medium may include program instructions, data files, and data structures solely or in combination. Program instructions recorded on the storage medium may have been specially designed and configured for the present invention, or may be known to or available to those who have ordinary knowledge in the field of computer software. Examples of the computer-readable storage medium include all types of hardware devices specially configured to record and execute program instructions, such as magnetic media, such as a hard disk, a floppy disk, and magnetic tape, optical media, such as compact disk (CD)-read only memory (ROM) and a digital versatile disk (DVD), magneto-optical media, such as a floptical disk, ROM, random access memory (RAM), and flash memory. Examples of the program instructions include machine code, such as code created by a compiler, and high-level language code executable by a computer using an interpreter.

The above-described methods and apparatuses for decoding/encoding scalable digital audio according to the present invention are not limited to the configurations and methods of the above-described embodiments, but some or all of the embodiments may be configured to be selectively combined such that the embodiments can be modified in various manners.

The invention claimed is:

1. A method of decoding scalable digital audio, comprising:

receiving a digital audio packet, including a plurality of pieces of direct audio channel data mapped to respective physical channels in a one-to-one correspondence and a plurality of pieces of indirect audio channel data indirectly mapped to respective physical channels;

extracting the pieces of indirect audio channel data from the digital audio packet;

generating pieces of physical audio channel data corresponding to a number of physical channels more than a number of pieces of indirect audio channel data using the pieces of indirect audio channel data; and matching the pieces of physical audio channel data to the respective physical channels in a one-to-one correspondence and then performing output, wherein the pieces of direct audio channel data are pulse code modulated wave files, and are maintained in a state of being uncompressed while the digital audio packet is being packaged, distributed, and stored.

2. The method of claim 1, wherein:

the digital audio packet includes a plurality of channel containers each adapted to record digital audio channel data; and each of the pieces of direct audio channel data and the pieces of indirect audio channel data is mapped to one of the plurality of channel containers in a one-to-one correspondence.

3. The method of claim 2, wherein the pieces of indirect audio channel data are recorded in at least part of a remainder of the channel containers in which the pieces of direct audio channel data have not been recorded.

4. The method of claim 3, wherein generating the pieces of physical audio channel data comprises generating the pieces of physical audio channel data corresponding to a number of physical channels more than the number of pieces of indirect audio channel data by performing a decompression process on the pieces of indirect audio channel data.

5. The method of claim 4, wherein:

the digital audio packet includes 16 channel containers;

a number of the pieces of direct audio channel data is equal to or more than 6 and equal to or less than 11; and the number of pieces of indirect audio channel data is 6.

6. The method of claim 5, wherein the number of pieces of direct audio channel data is even.

7. The method of claim 6, wherein the pieces of physical audio channel data are output as respective audio outputs of a high-multichannel audio system for a theater, which are equal to or more than 16 channels and equal to or fewer than 256 channels.

8. The method of claim 7, further comprising receiving channel assignment information corresponding to the digital audio packet;

wherein generating the pieces of physical audio channel data is performed based on the channel assignment information.

9. A method of coding scalable digital audio, comprising:

generating a plurality of pieces of direct audio channel data mapped to respective physical channels in a one-to-one correspondence;

generating pieces of indirect audio channel data that are synchronized with video sources corresponding to the pieces of direct audio channel data and that are indirectly mapped to respective physical channels; and generating a digital audio packet using the pieces of direct audio channel data and the pieces of indirect audio channel data, wherein a number of pieces of indirect audio channel data is less than a number of physical channels corresponding to the pieces of indirect audio channel data, wherein the pieces of direct audio channel data are pulse code modulated wave files, and are maintained in a state of being uncompressed while the digital audio packet is being packaged, distributed, and stored.

10. The method of claim 9, wherein:

the digital audio packet includes a plurality of channel containers each adapted to record digital audio channel data; and each of the pieces of direct audio channel data and the pieces of indirect audio channel data is mapped to one of the plurality of channel containers in a one-to-one correspondence.

11. The method of claim 10, wherein the pieces of indirect audio channel data are recorded in at least part of a remainder of the channel containers in which the pieces of direct audio channel data have not been recorded.

12. The method of claim 11, wherein the pieces of indirect audio channel data are compressed in order to be recorded in a number of channel containers less than a number of physically required channel containers, and are then recorded in the at least part of the remainder.

13. The method of claim 12, wherein:

the digital audio packet includes 16 channel containers;

a number of the pieces of direct audio channel data is equal to or more than 6 and equal to or less than 11; and the number of pieces of indirect audio channel data is 6.

14. The method of claim 13, wherein the number of pieces of direct audio channel data is even.

15. The method of claim 14, wherein the pieces of indirect audio channel data correspond to high-multichannel audio sources for a theater, which are equal to or more than 16 channels and equal to or fewer than 256 channels.

16. The method of claim 15, further comprising providing channel assignment information corresponding to the digital audio packet, together with the digital audio packet, so that the channel assignment information can be considered when the digital audio packet is decoded in a decoding stage.

* * * * *